US010100632B2

(12) United States Patent
Nyhavn et al.

(10) Patent No.: US 10,100,632 B2
(45) Date of Patent: Oct. 16, 2018

(54) PETROLEUM WELL FORMATION BACK PRESSURE FIELD METER SYSTEM

(71) Applicant: RESMAN AS, Ranheim (NO)

(72) Inventors: Fridtjof Nyhavn, Trondheim (NO); Christian Andresen, Vikhammer (NO)

(73) Assignee: RESMAN AS, Ranheim (NO)

( * ) Notice: Subject to any disclaimer, the term of this patent is extended or adjusted under 35 U.S.C. 154(b) by 182 days.

(21) Appl. No.: 15/039,555

(22) PCT Filed: Nov. 29, 2013

(86) PCT No.: PCT/NO2013/000054

§ 371 (c)(1),
(2) Date: May 26, 2016

(87) PCT Pub. No.: WO2015/080591

PCT Pub. Date: Jun. 4, 2015

(65) Prior Publication Data

US 2017/0022803 A1 Jan. 26, 2017

(51) Int. Cl.

| | |
|---|---|
| ***E21B 47/06*** | (2012.01) |
| ***E21B 33/124*** | (2006.01) |
| ***E21B 43/14*** | (2006.01) |
| ***E21B 49/08*** | (2006.01) |
| ***E21B 47/10*** | (2012.01) |

(52) U.S. Cl.

CPC ..... *E21B 47/06* (2013.01); *E21B 33/124* (2013.01); *E21B 43/14* (2013.01); *E21B 47/1015* (2013.01); *E21B 49/08* (2013.01)

(58) Field of Classification Search

CPC .... E21B 33/124; E21B 47/1015; E21B 49/08; E21B 43/14; E21B 47/06; E21B 33/1294

USPC ..... 166/131, 133, 149, 184, 188

See application file for complete search history.

(56) References Cited

U.S. PATENT DOCUMENTS

| | | | | |
|---|---|---|---|---|
| 6,131,451 | A | 10/2000 | Izbicki et al. | |
| 8,596,354 | B2 * | 12/2013 | Hartshorne | E21B 47/1015 166/250.12 |
| 2003/0056952 | A1 * | 3/2003 | Stegemeier | E21B 43/00 166/250.12 |
| 2003/0131991 | A1 * | 7/2003 | Hartog | E21B 27/02 166/250.12 |
| 2011/0024111 | A1 * | 2/2011 | Moen | E21B 43/08 166/278 |

(Continued)

FOREIGN PATENT DOCUMENTS

| | | |
|---|---|---|
| WO | WO 01/81914 A1 | 11/2001 |
| WO | WO 2013/135861 A2 | 9/2013 |

*Primary Examiner* — Blake E Michener

(74) *Attorney, Agent, or Firm* — Birch, Stewart, Kolasch & Birch, LLP

(57) ABSTRACT

A petroleum well formation pressure meter system includes a petroleum fluid conducting tubing in a borehole through a reservoir rock formation. The tubing includes a blank pipe section forming a blank-pipe-isolated first annulus section isolated by a first and a second packer and an adjacent non-blank pipe section beyond said first packer forming a tubing-communicating petroleum producing second annulus section. The first packer includes a tracer-conducting channel allowing through passage of tracer material from an inlet from a bellows including a fluid tracer in pressure communication with said blank-pipe-isolated annulus section, to an outlet to said tubing-communicating annulus section.

10 Claims, 6 Drawing Sheets

(56) References Cited

U.S. PATENT DOCUMENTS

| | | | | |
|---|---|---|---|---|
| 2011/0290480 | A1* | 12/2011 | Al-Gouhi | E21B 33/124 166/250.12 |
| 2013/0245948 | A1* | 9/2013 | Nyhavn | E21B 27/02 702/6 |
| 2016/0010454 | A1* | 1/2016 | Sira | E21B 47/1015 73/152.29 |
| 2016/0201454 | A1* | 7/2016 | Nyhavn | E21B 27/02 73/152.51 |
| 2017/0275991 | A1* | 9/2017 | Farley | E21B 49/088 |

* cited by examiner

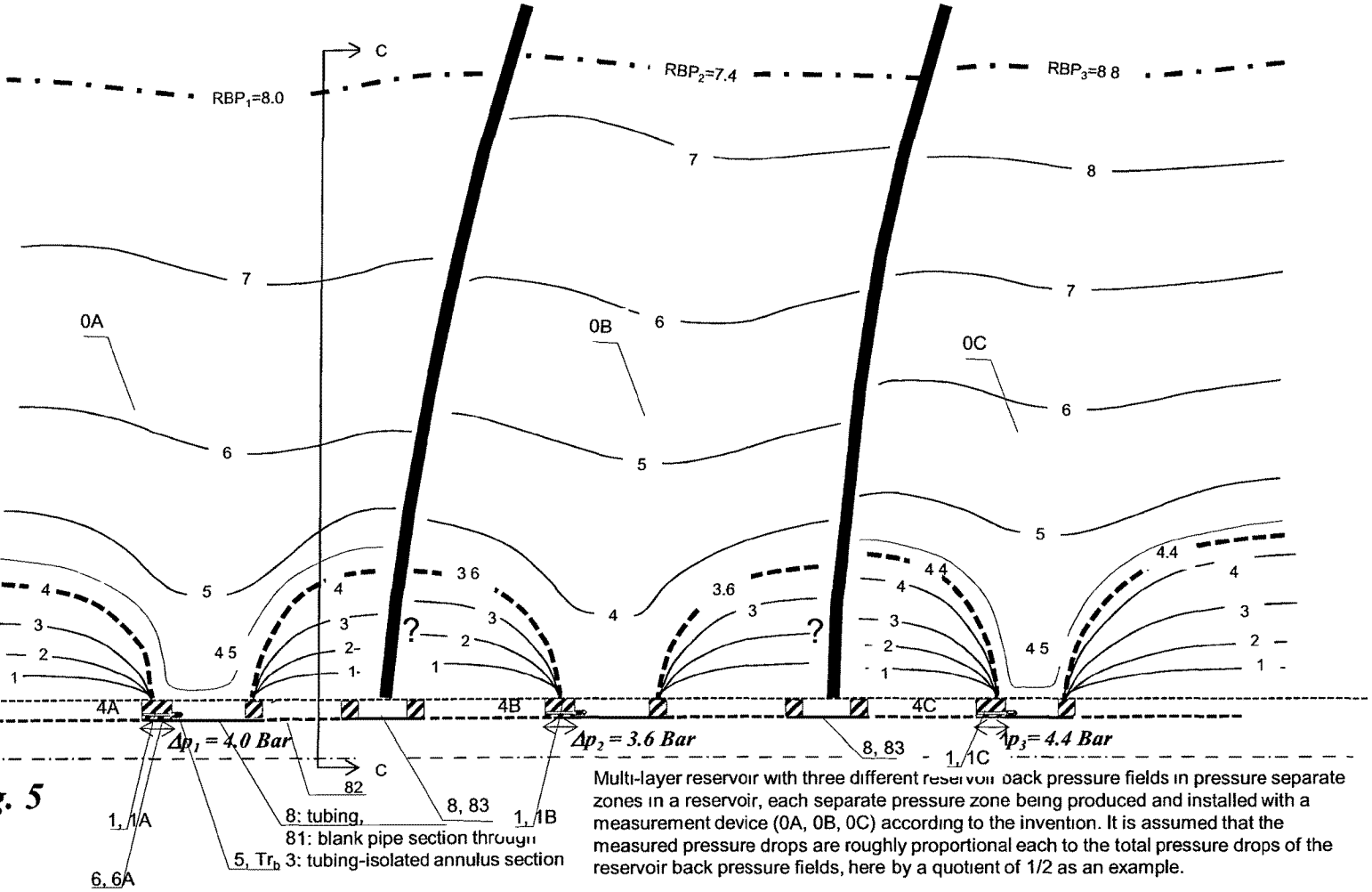

Multi-layer reservoir with three different reservoir back pressure fields in pressure separate zones in a reservoir, each separate pressure zone being produced and installed with a measurement device (0A, 0B, 0C) according to the invention. It is assumed that the measured pressure drops are roughly proportional each to the total pressure drops of the reservoir back pressure fields, here by a quotient of 1/2 as an example.

*Fig. 5*

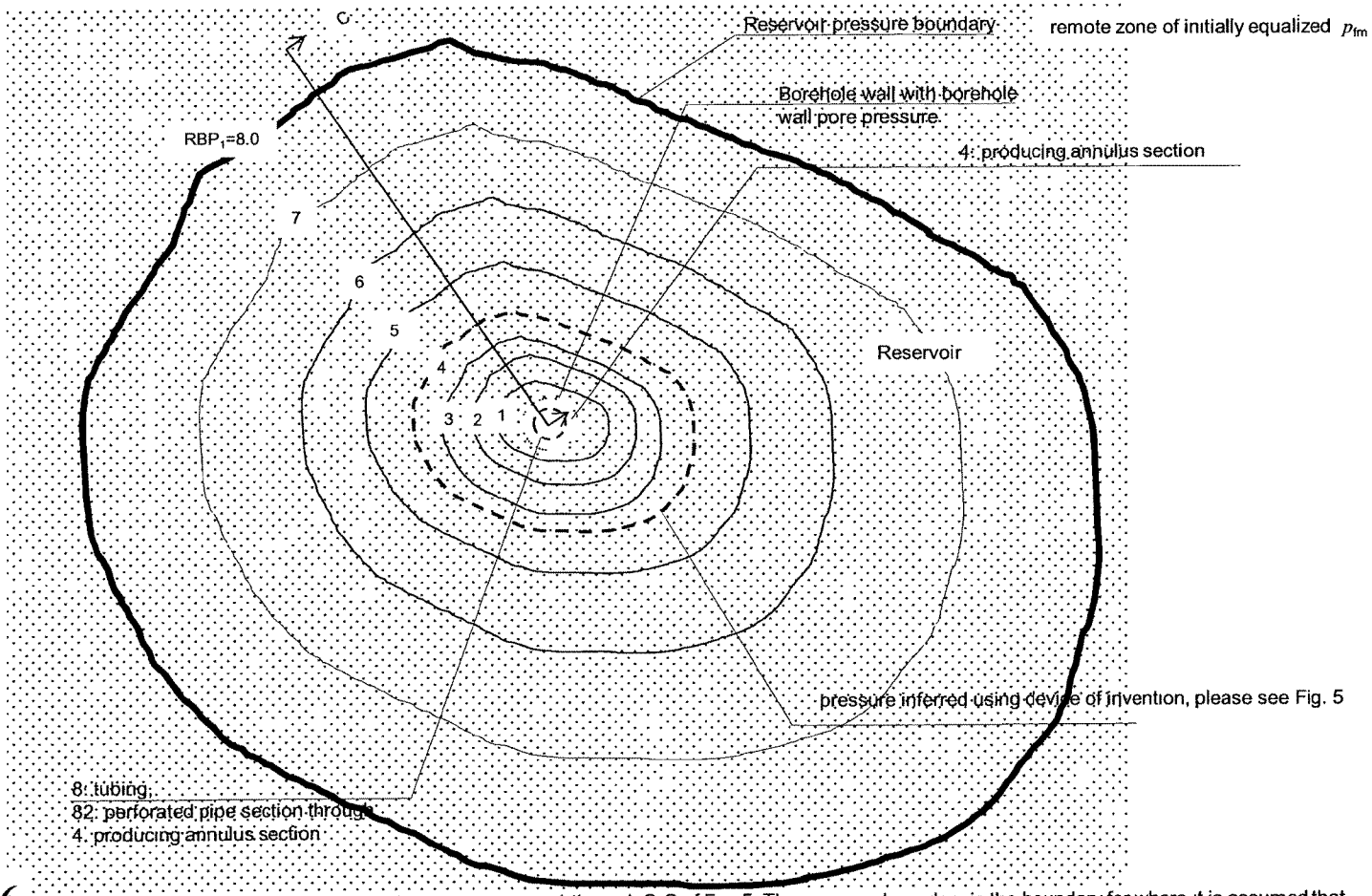

*Fig. 6* Reservoir back pressure field in a producing reservoir zone 1 through C-C of Fig. 5. The reservoir boundary is the boundary for where it is assumed that no significant fluid flow occurs while draining the reservoir locally, i.e. the location of the reservoir boundary pressure. There is a negative pressure gradient inwards toward the borehole wall were the fluid is drained

PETROLEUM WELL FORMATION BACK PRESSURE FIELD METER SYSTEM

INTRODUCTION

The invention is in the field of reservoir monitoring by estimating the formation pressure (the pore pressure on the borehole wall), in selected depth intervals in a petroleum producing well while draining the reservoir, using installed tracer sources in potentially petroleum-producing zones of the well. Depending on the configuration of the tracer sources installation method and the flow pattern in the formation, the so-called reservoir back pressure field and the reservoir boundary pressure may be estimated.

Figure 1:
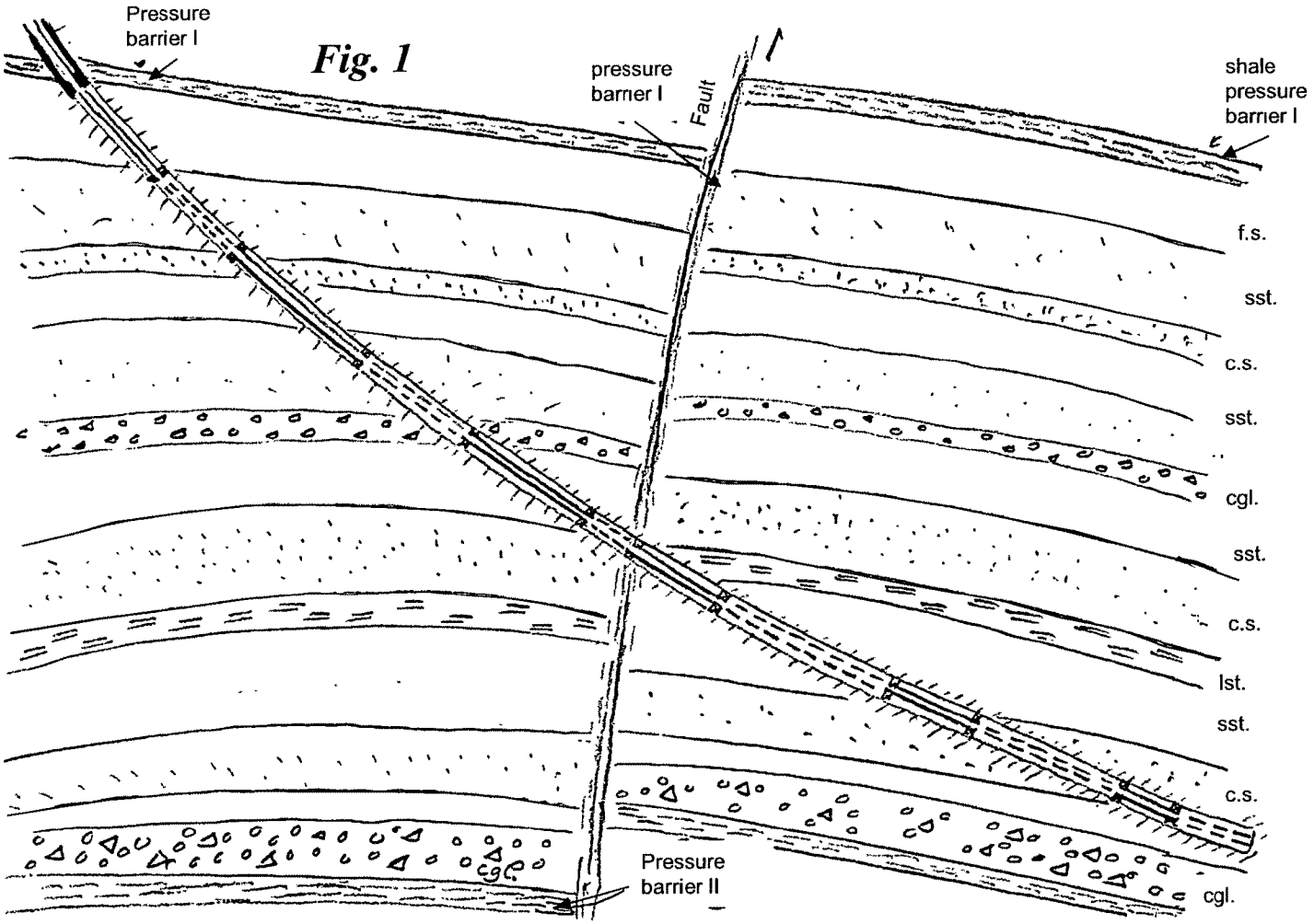

A producing petroleum well, particularly a naturally producing petroleum well, will decrease the pressure of the reservoir formation. A simplified section through an imagined petroleum well drilled through geological formations, some of which are reservoir rocks, and the well completed, is illustrated in FIG. 1. The geological formation comprises in the parts of a reservoir shown, an upper general pressure barrier I, e.g. shale, which is rather fluid proof, and another lower pressure barrier II. There may also be a fault which comprises locally metamorphosed rocks or precipitations which forms a third pressure barrier which may be more or less vertical and cuts through the formations. The reservoir back pressure in the different parts of the reservoir is what drives fluids out through the borehole walls to the producing annulus and towards apertures in a production pipe in the well. The reservoir back pressure field within the reservoir, apart from the hydrostatic pressure gradient, may be approximately homogeneous when the production valve has been let closed and the reservoir back pressure field has equalized for a sufficiently long period of time, because the field may have a weak throughout permeability which allows a slow pressure equalization to take place within the reservoir when everything else is held static. Normally, the reservoir back pressure field has a large buffer capacity with a very long time constant. The reservoir back pressure field, however, is not homogenous during production. It will change locally according to the drain pressure in the tubing, according to local permeability, viscosity of the produced fluid, and local geological features, and form a varying pressure gradient around the well when production fluids such as oil, gas and water flow when the production valve is open. One of the main reasons the reservoir back pressure field may change inhomogeneously is that it has not had sufficient time to be equalized far from the well. It will thus of interest to try to map the reservoir back pressure field along a producing well.

BACKGROUND ART

The international PCT patent application WO2013135861A2 published 19 Sep. 2013 by Terje Sira and Tor Bjørnstad presents an apparatus for tracer based flow measurement. The apparatus comprises a tracer chamber for installation on a production tubing. The tracer chamber is arranged for holding tracer and is arranged to be linked, in use, to the pressure in an annulus about the production tubing. The tracer chamber comprises an outlet for fluid communication between the tracer chamber and the fluid within the production tubing. Tracer is released through the outlet into the production tubing in accordance with a pressure differential between the annulus and the production tubing. The general principle of Sira and Bjørnstads published application is illustrated in FIG. 1 of WO2013135861A2. Its tracer chamber is arranged in a geological formation made of a hydrocarbon production zone, such as sandstone or carbonates, framed by impermeable layers above and below, such as shales or salts. The tubing has been installed in the formation and it is separated from the geological rocks by a sand-filled annulus and a casing or a naturally cut borehole wall. In the annulus the production zone is typically isolated from the geological formations above and below by packers. The production from the zone is controlled at the level of one or more ICD's.

BRIEF SUMMARY OF THE INVENTION

The present invention is a petroleum well formation back pressure meter system comprising a petroleum fluid conducting tubing (8) in a borehole through a reservoir rock formation, said tubing comprising a blank pipe section (81) forming a blank-pipe-isolated first annulus section (3) isolated by a first and a second packer (1, 2), said tubing (8) comprising an adjacent non-blank pipe section (82) beyond said first packer (1) forming a tubing-communicating petroleum producing second annulus section (4), said first packer (1) comprising a tracer-conducting channel (6) allowing through passage of tracer material (Trb) from an inlet (61) from a tracer-holding bellows (5) in pressure communication with said blank-pipe-isolated annulus section (3), to an outlet (62) to said tubing-communicating annulus section (4).

The present invention is also a method for estimating a petroleum well formation back pressure, comprising arranging a petroleum well formation back pressure meter system (0) according to claim 1, producing petroleum fluids through said tubing (8), conducting sampling of said petroleum fluids and analyzing for said tracer material (Trb) and calculating a tracer flux (ΦD), estimating, based on said tracer flux (Φb), a pressure gradient (Δb) over said first packer (1), using said pressure gradient (Δb) over said first packer (1) to estimate a local formation back pressure about said petroleum well.

The present invention may further be defined as a method for estimating a petroleum well formation back pressure, comprising arranging a petroleum well formation back pressure meter system as defined above, having pressure-calibrated said tracer-conducting channel (6), producing petroleum fluids through said tubing (8), conducting sampling of said petroleum fluids and analyzing for said tracer material (Trb) and calculating a tracer flux (Φb) of the produced petroleum fluids, and estimating, based on said tracer flux (Φb), a pressure gradient (Δp) over said first packer (1), and using said pressure gradient (Δp) to estimate a local formation back pressure about said petroleum well.

FIGURE CAPTIONS

The invention is illustrated in the attached drawing figures, wherein

FIG. 1 illustrates a simplified section through part of an imagined petroleum well installed through drilled geological formations, some of which are reservoir rocks, and the well completed. A production pipe in the reservoir formations has separate, perforated or by other means open production zones isolated by packers, and also blank pipe sections between the production zones.

Figure 2:
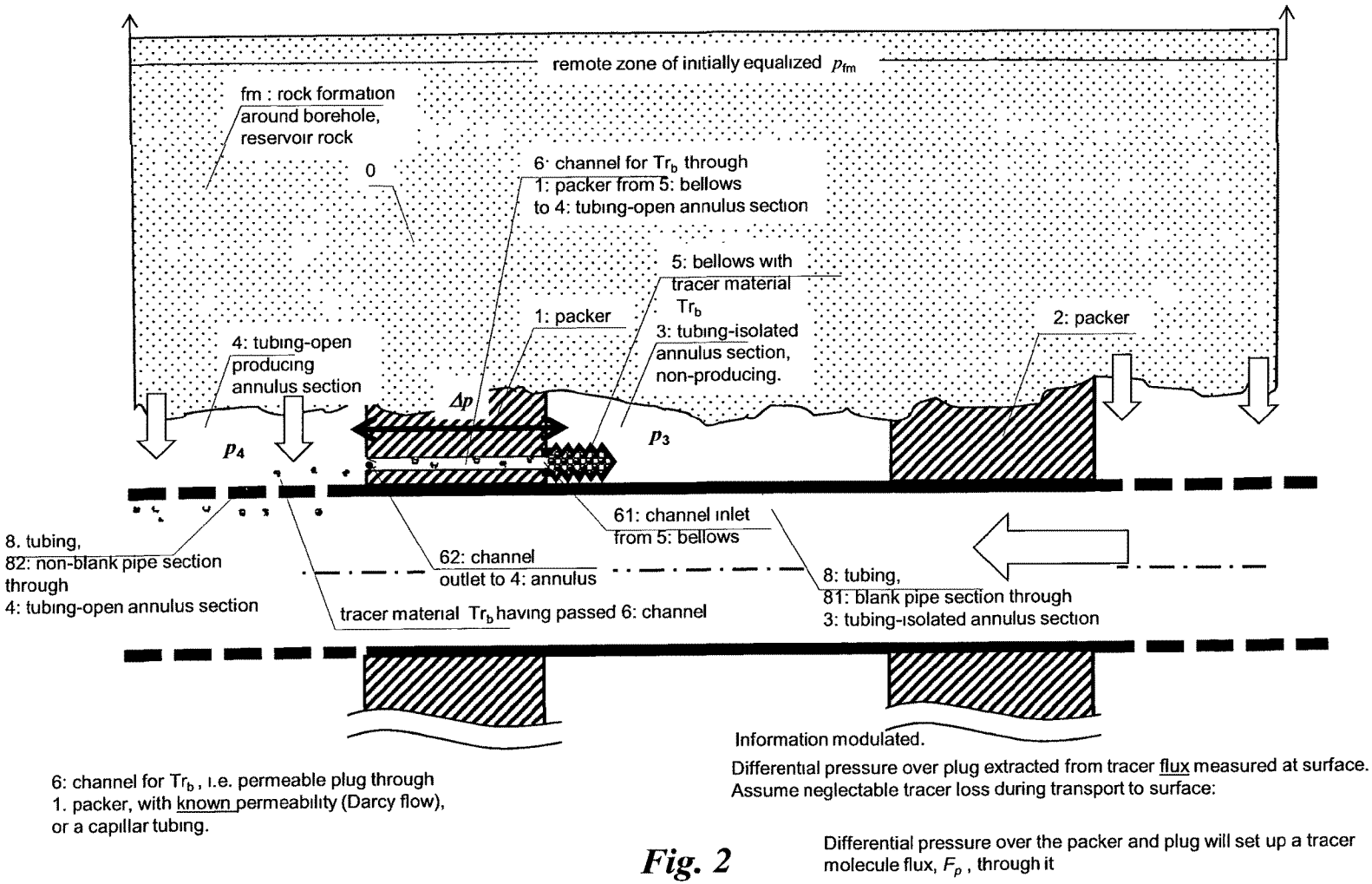

FIG. 2 is an illustration of a petroleum well formation back pressure estimating system according to the invention. The drawing illustrates a petroleum fluid conducting tubing (8) in a borehole through a reservoir rock formation. The tubing comprises a blank pipe section (81) forming a blank-pipe-isolated first annulus section (3) isolated by a first and a second packer (1, 2). The tubing (8) comprises adjacent non-blank pipe section (82) beyond the first packer (1) forming a tubing-communicating petroleum producing second annulus section (4) which is drained to the tubing (8). Petroleum fluids enter through the borehole wall into the annulus space from the reservoir rock due to the borehole wall pore pressure, and takes up tracer material (Trb) leaked through the channel (6) in the first packer (1). The first packer (1) comprises the tracer-conducting channel (6) allowing through passage of tracer material (Trb) from an inlet (61) from a bellows (5) in pressure communication with said blank-pipe-isolated annulus section (3), to an outlet (62) to said tubing-communicating annulus section (4).

The term "blank pipe" is understood as a pipe section wherein the pressure of the tubing annulus does not communicate with the main bore of the tubing, or a tubing section which functions equivalently. The term "packer" is here a packer around the tubing sealing against the wall or liner, a sealing around the tubing preventing annulus fluid flow past the sealing, or any equivalently working element. The term "bellows" implies an element which contains tracer fluid and which is in contact with the pressure, here the pressure in the annulus fluid, and which releases tracer fluid due to the pressure in the annulus fluid, and in the present case releases the tracer material to the channel through the packer. The term "bellows" may thus be equivalent to a piston chamber or a diaphragm with an outlet to a channel through the packer.

Figure 3:
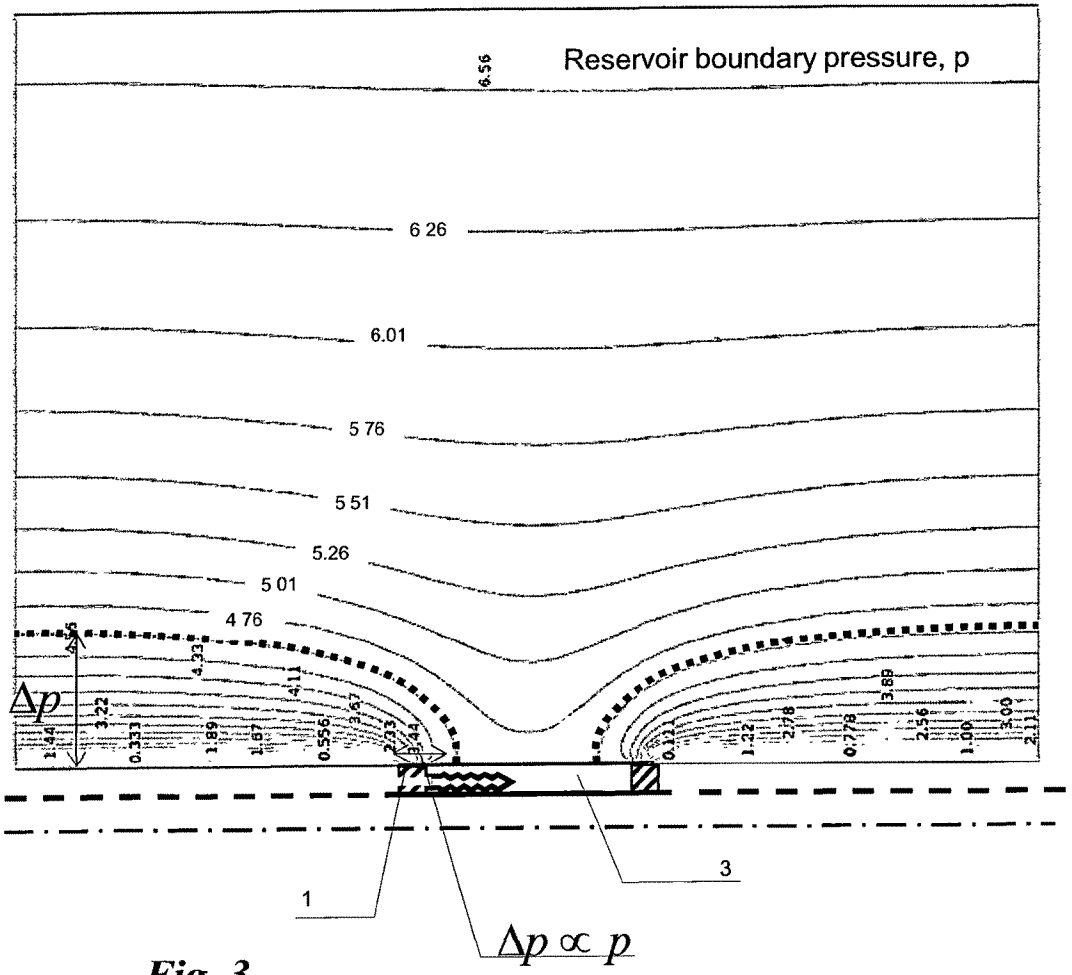

FIG. 3 is a modelled diagram of the reservoir back pressure field in the rocks behind the borehole wall, outside a blank pipe section with a packer-isolated bellows as illustrated in FIG. 2 above. From the produced fluids the tracer flux is measured, and the pressure gradient (Δp) across the packer (1) is estimated. The pressure gradient (Δp) across the packer may reflect the reservoir boundary pressure (p) some distance or depth from the borehole into the surrounding formation from the well. The image is the result of a COMSOL simulation. In the calculated example the reservoir back pressure is about 6.56 Bar. The pressure gradient (Δp) from the back pressure field just across the blank pipe section extends down to just below 4.56 Bar, one may see the modelled 4.76 Bar isobar line approach the isolated annulus (3).

Figure 4:
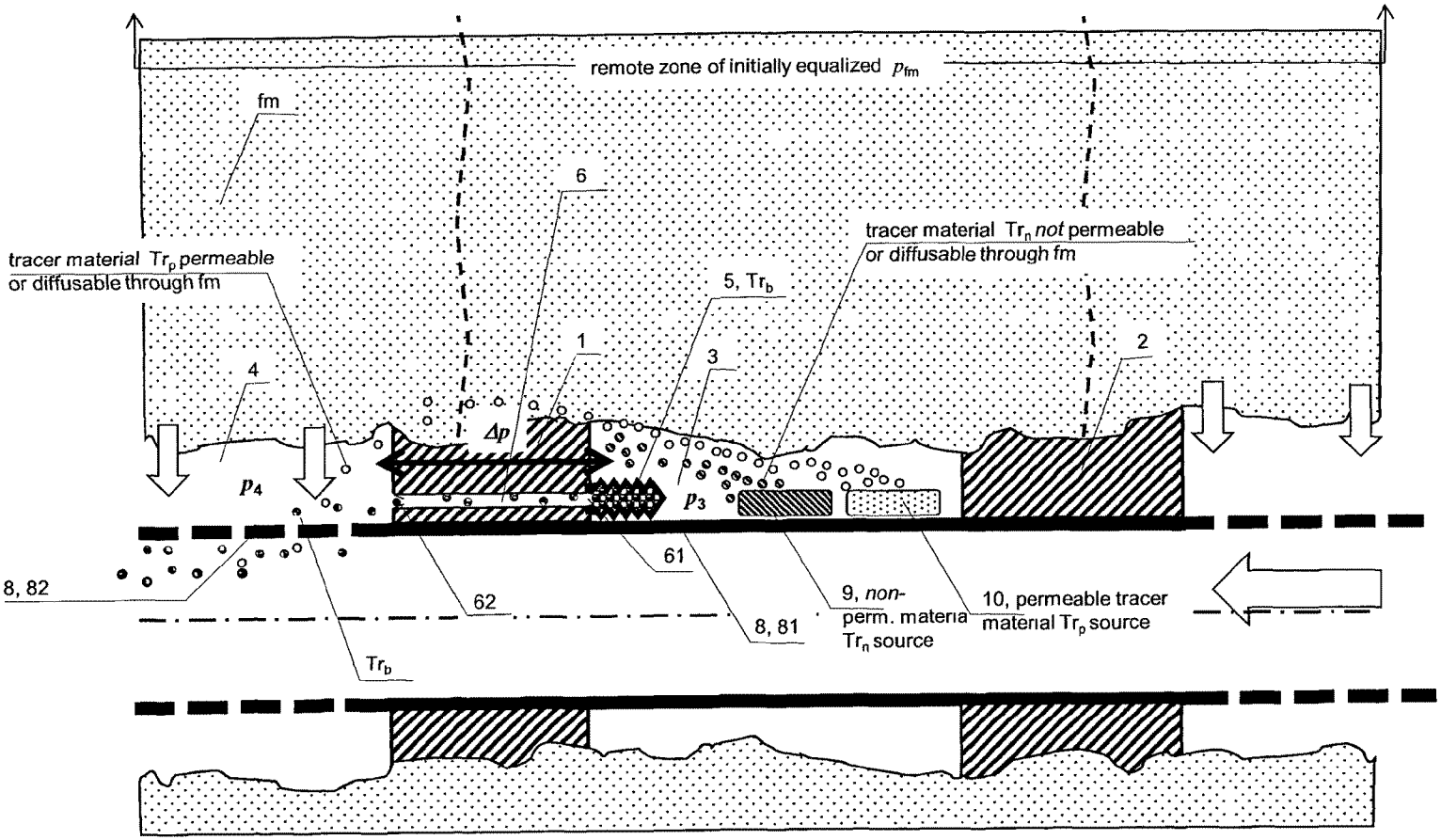

FIG. 4 is an embodiment of the invention wherein two additional tracers systems used for checking the integrity of the packers (1, 2). The integrity of the packers (1, 2) will be crucial for the functionality of the distributed formation pressure unit according to the invention. To reduce the uncertainty of this integrity, but also to add value to the monitoring, it is possible to introduce two types of intelligent tracer systems, a $Tr_n$ source of tracer material not permeable or diffusable through the reservoir rock about the borehole, and a $Tr_p$ source which may permeate or diffuse through the same rocks. The two tracer systems ($Tr_n$, $Tr_p$) are arranged in the packer-isolated blank pipe annulus section (3), both with a release into the fluid that is expected to fill the section.

FIG. 5 illustrates three packer-isolated pressure zones in a multilayered reservoir, wherein the system of the invention has been installed. In the three different pressure zones of the reservoir, the reservoir back pressure differs between 8.0 Bar in zone 1, to 7.4 Bar in zone 2, to 8.8 Bar in zone 3, but the permeability is the same in the layers. Each separate pressure zone is provided with a measurement device according to the invention. It is assumed that the measured pressure drop is roughly proportional to the total pressure drop of the reservoir back pressure field, here by a quotient of ½ as an example.

FIG. 6 is an illustration of the reservoir back pressure field in a producing reservoir zone such as across zone 1 through C-C of FIG. 5. The reservoir boundary is the boundary for where it is assumed that no significant fluid flow occurs while draining the reservoir locally, i.e. the location of the reservoir boundary pressure. The broken line isobar at 4 Bar indicates the pressure 4 Bar inferred by the pressure gradient (Δp) over the packer (1) using the device of the invention as illustrated in FIG. 5.

EMBODIMENTS OF THE INVENTION

Permanent tracers in producer wells have in the background art been used for estimating the nature and volume ratios of production flows, and for estimating the influx profiles of the production flows. The present invention is a system and method for estimating formation back pressure within the rock far behind the borehole wall in production zones.

Basic System of the Invention

The present invention is a petroleum well formation back pressure meter system comprising a petroleum fluid conducting tubing (8) in a borehole through a rock formation, wherein said tubing comprises a blank pipe section (81) forming a blank-pipe-isolated first annulus section (3) isolated by a first and a second packer (1, 2), said tubing (8) also comprising an adjacent non-blank pipe section (82) beyond said first packer (1) forming a tubing-communicating petroleum producing second annulus section (4). Further according to the invention, said first packer (1) comprises a tracer-conducting channel (6) allowing through passage of tracer material (Trb) from an inlet (61) from a bellows (5) comprising a fluid tracer ($Tr_b$) in pressure communication with said blank-pipe-isolated annulus section (3), to an outlet (62) to said tubing-communicating annulus section (4). The tubing will conduct produced fluid downstream, generally out to the surface. Petroleum fluids produced through the tubing are sampled downstream and analyzed for their presence of tracer materials ($Tr_b$) and optional other tracer materials.

FIG. 2 is an illustration of a petroleum well formation back pressure estimating system according to the invention. The drawing illustrates a petroleum fluid conducting tubing (8) in a borehole through a reservoir rock formation. The tubing comprises a blank pipe section (81) forming a blank-pipe-isolated first annulus section (3) isolated by a first and a second packer (1, 2). The tubing (8) comprises adjacent non-blank pipe section (82) beyond the first packer (1) forming a tubing-communicating petroleum producing second annulus section (4) which is drained to the tubing (8). In an embodiment of the invention the second annulus section (4) is in fluid communication with the same geological reservoir formation (fm) as the first annulus section (3). The annulus section (4) may be packed with a permeable filler material such as a gravel pack or sand, or only fluid-filled. Petroleum fluids enter through the borehole wall into the annulus space from the reservoir rock due to the borehole wall pore pressure, and takes up tracer material (Trb) leaked through the channel (6) in the first packer (1). The first packer (1) comprises the tracer-conducting channel (6) allowing through passage of tracer material (Trb) from an inlet (61) from a bellows (5) in pressure communication with said blank-pipe-isolated annulus section (3), to an outlet (62) to said tubing-communicating annulus section (4). The channel (6) may comprise a capillary tube, a porous material or similar, which makes it appear as a Darcy-channel which controls the pressure-induced flow of tracer material. In practical implementations the properties of the capillary tubes of WO2013135861A2 may be employed but arranged conducting tracer material through packer (1) in the setting of the present invention.

FIG. 3 is a modelled diagram of the reservoir back pressure field in the rocks behind the borehole wall, outside a blank pipe section with a packer-isolated bellows as illustrated in FIG. 2 above. From the produced fluids the tracer flux is measured, and the pressure gradient (Δp) across the packer (1) is estimated. The pressure gradient (Δp) across the packer may reflect the reservoir boundary pressure (p) some distance or depth from the borehole into the surrounding formation from the well. This virtually probed pressure at a depth into the surrounding formation will depend on the distance between the two packers; The larger the distance between packers, the further out isobars will approach the isolated blank pipe annulus—the deeper you seem to observe the pressure into the reservoir, i.e. the closer the pressure gradient (Δp) approaches the reservoir boundary pressure. The image is the result of a COMSOL simulation. In the calculated example the reservoir back pressure is about 6.56 Bar. The pressure gradient (Δp) from the back pressure field just across the blank pipe section extends down to just below 4.56 Bar, one may see the modelled 4.76 Bar isobar line approach the isolated annulus (3). Thus a total pressure difference of only about 1.99 Bar, i.e. 2 Bar exists between the reservoir boundary pressure and the measured (estimated) pressure in the packer-isolated blank pipe annulus. The pressure gradient (Δp) across the packer is 4.56 Bar between the isolated annulus (3) and the producing, perforated annulus (4).

FIG. 5 illustrates three packer-isolated pressure zones in a multilayered reservoir, wherein the system (0) (0A, 0B, 0C) of the invention has been installed. In the three different pressure zones of the reservoir, the reservoir back pressure differs between 8.0 Bar in zone 1, to 7.4 Bar in zone 2, to 8.8 Bar in zone 3, but the permeability is the same in the layers. Each separate pressure zone is provided with a measurement device according to the invention. It is assumed that the measured pressure drop is roughly proportional to the total pressure drop of the reservoir back pressure field, here by a quotient of ½ as an example. Each separate pressure zone may be connected to a separate pressure system. In the illustrated system, as a result of the tracer measurements and the inferred pressure gradients, one may decide to close a sliding sleeve valve to halt the production from the lowest pressure reservoir zone 2 until production has reduced the borehole wall pressure of zone 3 and zone 1 to a lower level so as for reducing the risk of losing fluid to zone 2.

FIG. 6 is an illustration of the reservoir back pressure field in a producing reservoir zone such as across zone 1 through C-C of FIG. 5. The reservoir boundary is the boundary for where it is assumed that no significant fluid flow occurs while draining the reservoir locally, i.e. the location of the reservoir boundary pressure. There is a negative pressure gradient inwards toward the borehole wall were the fluid is drained. The broken isobar at 4 Bar indicates the pressure 4 Bar inferred as the pressure gradient (Δp) over the packer (1) using the device of the invention as illustrated in FIG. 5.

Effect of the System of the Invention

The petroleum well formation back pressure system according to the invention works as follows: With reference to FIG. 2, FIG. 5, and FIG. 6, the fluid producing annulus (4) drains, over time, the reservoir, creating a formation back pressure field from the reservoir back pressure down to a zero level set as the tubing pressure, which in this context may be used as a local reference pressure. One may assume that in the tubing isolated annulus (3), the pressure difference from the formation back pressure at the reservoir pressure boundary will be much less than the pressure difference from the petroleum fluid producing annulus (4) to the formation back pressure at the reservoir pressure boundary, because the petroleum fluid permeability in the surrounding rock formation (fm) does not allow instant pressure equilibrium to be reached. Thus the pressure (p3) in the tubing isolated annulus section (3) may represent an approximation to the back pressure p in the formation, please see FIG. 3, FIG. 5, and FIG. 6. Thus the pressure (p3) in the packer-isolated annulus (3) observes the same pressure as exists some distance into the formation behind the borehole wall in the tubing-open producing annulus (4). The pressure gradient (Δp) over the packer (1) may be approximately proportional to the formation back pressure p. In FIG. 3. The above petroleum well formation back pressure meter system works passively so as for allowing compression of said bellows (5) by pressure (p3) in said first annulus section (3) to force tracer material (Trb) through said channel (6) to said open, tubing-communicating second annulus section (4). The open second annulus section (4) will allow said tracer material (Trb) to escape to form part of the production flow. The tracer flux will be proportional to the pressure gradient across the packer (1). Downstream, at the surface or downstream below the surface, the production fluids with said tracer material (Trb) are sampled and analyzed and measured for tracer flux (Φb). The tubing-isolated annulus section (3) is ideally not producing, so the tracer flux (Φb) may be assumed to be proportional to a pressure gradient (Δp) across said packer (1). Knowing the pressure gradient (Δp) across said packer (1), one has a good indication of the pressure (p3) (relative to the second annulus (4) pressure) in the blank-pipe-isolated annulus (3). One may assume that the pressure in the blank-pipe isolated annulus (3) has some proportionality factor to the formation boundary pressure (p, $p_{fm}$) behind the non-producing annulus (3) and the producing annulus (4).

The petroleum well formation back pressure estimating system according to the invention may be arranged with different unique tracers (Trb) in several producing, packer-isolated zones or formations (fm) along the production tubing, thus enabling estimation of back pressure for each system-installed zone or formation, such as in FIG. 5.

In the petroleum well formation back pressure meter system (0, 0A, 0B, 0C) of the invention, one may have either calibrated or non-calibrated, but equally tracer-conducting channels (6). In an embodiment of the invention said tracer-conducting channel (6) is calibrated with regard to pressure gradient.

In an embodiment of the invention shown in FIG. 5, there is arranged in the petroleum well completion along the tubing (8), two, three, or more petroleum well formation pressure meter systems (0A, 0B, 0C . . . ) according to the invention. Each formation pressure meter system (0A, 0B, 0C . . . ) is separated by a packer-isolated blank pipe section (83), and each tracer material (TrbA, TrbB, TrbC, . . . ) is unique.

Obtaining Non-Calibrated Relative Pressures:

If the tracer-conducting channels (6, 6A, 6B, 6C, . . . ) are equal or at least have equal tracer flux rates relative to pressure, but not necessarily pressure calibrated, the relative formation pressures for the separate or isolated zones may be estimated by the following method:

providing a petroleum well completion with two, three, or more petroleum well formation pressure meter systems (0A, 0B, 0C . . . ) of the invention, separating each formation pressure meter system (0A, 0B, 0C . . . ) by a packer-isolated blank pipe section (83), using unique tracer materials (TrbA, TrbB, TrbC, . . . ) for each system (0A, 0B, 0C, . . . )

producing petroleum fluids through said tubing (8), conducting sampling of said petroleum fluids and analyzing for said tracer material (TrbA, TrbB, TrbC, . . . ) and calculating a tracer fluxes (ΦbA, ΦbB, ΦbC, . . . ), estimating, based on said tracer flux (ΦbA, ΦbB, ΦbC, . . . ), relative pressure gradients (ΔbA, ΔbB, ΔbC, . . . ) over said first packers (1A, 1B, 1C), using said pressure gradients (Δb) over said first packers (1A, 1B, 1C, . . . ) to estimate relative local formation back pressures about said petroleum well.

Knowing, as above, the relative pressure gradients (ΔbA, ΔbB, ΔbC, . . . ) over said first packers (1A, 1B, 1C) and using the pressure gradients (Δb) over the first packers (1A, 1B, 1C, . . . ) to estimate relative local formation back pressures about said petroleum well, even without having calibrated pressure properties, may be used by the well operator to adjust an influx control device from one or more of the producing annulus zones (4A, 4B, 4C, . . . ). It may be advantageous to adjust the influx control devices to obtain equal formation pressures in order not to induce reverse flow in any of the producing zones, and further to adjust the influx control devices as the production proceeds in order to maintain good relative pressure conditions.

Obtaining Calibrated Pressures:

If, in addition, the tracer conducting channels (6A, 6B, 6C, . . . ) are pressure calibrated, one may use the above method to indirectly measure the true formation pressures and thus estimate with good approximation the formation boundary back pressures for each zone.

The steps above for conducting sampling of said petroleum fluids and analyzing for said tracer material (TrbA, TrbB, TrbC, . . . ) and calculating a tracer fluxes (ΦbA, ΦbB, ΦbC, . . . ) is a task for the person skilled in the art, who will know how to conduct instantaneous or average sampling to obtain representative tracer concentration values, and take due care in case of slug flow or fluid slip problems in the well. One has to conduct a series of samples and analyze each sample for concentration in order to integrate over time to obtain the tracer flux.

Packer Integrity Control

It is advantageous to know whether the packers (1, 2) are properly installed and tight so as for being fluid-proof against the surrounding borehole wall and not leaking petroleum fluids nor water from the confined annulus zone (3). FIG. 4 is an embodiment of the invention wherein two additional tracers systems used for checking the integrity of the packers (1, 2). The integrity of the packers (1, 2) will be crucial for the functionality of the distributed formation pressure unit according to the invention. To reduce the uncertainty of this integrity, but also to add value to the monitoring, it is possible to introduce two types of intelligent tracer systems, a $Tr_n$ source of tracer material not permeable, i.e. non-diffusing through the reservoir rock about the borehole, and a $Tr_p$ source which is permeable or diffusable through the same reservoir rocks.

The two tracer systems ($Tr_n$, $Tr_p$) are arranged in the packer-isolated blank pipe annulus section (3), both with a release property into the fluid that is expected to fill the section: One with tracer $Tr_n$ that is not capable of penetrating the surrounding formation (fm) and/or one with tracer $Tr_p$ that will penetrate the surrounding formation (fm).

It is well known in the field that tracers based on longer molecule chains penetrate less easily through reservoir rocks than tracers based on shorter molecule chains do. The person skilled in the art will know how to obtain formation non-penetrating and formation penetrating tracers ($Tr_n$, $Tr_p$).

Thus in an embodiment of the petroleum well formation back pressure meter system of the invention it comprises a first auxiliary second tracer system (9) releasing first auxiliary tracer molecules ($Tr_n$) in said isolated first annulus section (3), said first auxiliary tracer material ($Tr_n$) not capable of passing through the geological material of said formation (fm) adjacent to said first and/or second packers (1, 2). If the first auxiliary tracer molecules ($Tr_n$) are detected downstream, one or both of packers (1) or (2) are leaking somehow.

A further check of the packers of the petroleum well formation back pressure meter system described above, comprises a second auxiliary second tracer system (10) releasing second auxiliary tracer molecules ($Tr_p$) in said isolated first annulus section (3), said second auxiliary tracer material ($Tr_p$) capable of passing through the geological material of said formation (fm) outside of said first or second packers (1, 2). If the second auxiliary tracer molecules $Tr_p$ are detected downstream, and the first auxiliary tracer molecules $Tr_n$ are not detected, packers (1) and (2) are properly installed with regard to fluid-proofness.

The detection of one or both of the two tracers are ideally interpreted as:

1* Detecting $Tr_p$ and $Tr_n$: Packer is leaking.

2* Detecting $Tr_p$ (and not $Tr_n$): Packer is OK. The permeability of the reservoir rock is indicated from (Δp) (transient).

3* No tracer $Tr_n$, $Tr_p$ seen: Packer is good, formation is tight or the back pressure is low.

From FIG. 4 one will see that situation 2* is illustrated: The formation-penetrating tracer $Tr_p$ enters the producing annulus (4) by permeating through the formation (fm) while the non-penetrating tracer $Tr_n$ does not.

The permeability level can be estimated from Δp.

Advantages of the Invention

The present invention is a fully passive formation pressure measurement device system using tracers released through some plug with known permeability, in an annulus zone isolated by packers. All these are known, passive building elements. With the present invention it is possible to monitor formation pressures in one or more production zones without having to shut down and pressure-equalize each producing zone. The present invention is a new combination of known elements are combined into a wireless distributed formation pressure monitoring system.

According to the present invention, information is extracted from the tracer flux from an installed tracer source that releases tracer as a function of the differential pressure between a producing and a non-producing section of the borehole wall. By matching data to models the technique may enable estimation of pressures some distance into the near wellbore formation, —reservoir backpressure being the ultimate goal.

Continually monitoring the tracer flux for each producing zone adds data for formation evaluation while producing fluids from the well. So it contributes to our ability to dynamic updating the well and reservoir model.

The invention claimed is:

1. A petroleum well formation pressure meter system comprising:

a petroleum fluid conducting tubing in a borehole through a reservoir rock formation, said tubing comprising:

a blank pipe section forming a blank-pipe-isolated first annulus section isolated by a first and a second packer; and an adjacent non-blank pipe section beyond said first packer forming a tubing-communicating petroleum producing second annulus section, wherein said first packer comprises a tracer-conducting channel allowing through passage of tracer material from an inlet from a bellows comprising a fluid tracer in pressure communication with said blank-pipe-isolated annulus section, to an outlet to said tubing-communicating annulus section.

2. The petroleum well formation back pressure meter system of claim 1, further comprising a first auxiliary tracer system releasing first auxiliary tracer molecules in said isolated first annulus section, said first auxiliary tracer material not capable of passing through the geological material of said formation adjacent to said first and/or second packers.

3. The petroleum well formation back pressure meter system of claim 2, further comprising a second auxiliary tracer system releasing second auxiliary tracer molecules in said isolated first annulus section, said second auxiliary tracer material capable of passing through the geological material of said formation outside of said first or second packers.

4. A petroleum well completion comprising two or more of the petroleum well formation pressure meter systems according to claim 3, wherein each formation pressure meter system is separated by a packer-isolated blank pipe section, and each tracer material is unique.

5. A petroleum well completion comprising two or more of the petroleum well formation pressure meter systems according to claim 2, wherein each formation pressure meter system is separated by a packer-isolated blank pipe section, and each tracer material is unique.

6. A petroleum well completion comprising:

two or more of the petroleum well formation pressure meter systems according to claim 1, wherein each formation pressure meter system is separated by a packer-isolated blank pipe section, and each tracer material is unique.

7. A method for estimating a petroleum well formation back pressure, comprising the steps of:

arranging the petroleum well formation back pressure meter system according to claim 1;

producing petroleum fluids through said tubing;

conducting sampling of said petroleum fluids and analyzing for said tracer material and calculating a tracer flux;

estimating, based on said tracer flux, a pressure gradient over said first packer; and using said pressure gradient over said first packer to estimate a local formation back pressure about said petroleum well.

8. The method of claim 7, further comprising the steps of:

using a petroleum well completion comprising two or more petroleum well formation pressure meter systems;

arranging said petroleum well formation back pressure meter system, each formation pressure meter system being separated by a packer-isolated blank pipe section, and each tracer material being unique;

producing petroleum fluids through said tubing;

conducting sampling of said petroleum fluids and analyzing for said tracer material and calculating a tracer fluxes;

estimating, based on said tracer flux, relative pressure gradients over said first packers; and using said pressure gradients over said first packers to estimate relative local formation back pressures about said petroleum well.

9. The method of claim 7, further comprising the steps of:

in said petroleum well formation back pressure meter system, further installing a first auxiliary tracer system releasing first auxiliary tracer molecules in said isolated first annulus section, said first auxiliary tracer material not capable of passing through the geological material of said formation adjacent to said first and/or second packers;

analyzing one or more of said samples of said petroleum fluids for said first auxiliary tracer material; and if detecting said first auxiliary tracer material, determining that said first or second packers are leaking, if not they are proof.

10. The method of claim 9, further comprising the steps of:

in said petroleum well formation back pressure meter system, further installing a second auxiliary tracer system releasing second auxiliary tracer molecules in said isolated first annulus section, said second auxiliary tracer material capable of passing through the geological material of said formation outside of said first or second packers;

analyzing one or more of said samples of said petroleum fluids for said second auxiliary tracer material; and if detecting said second auxiliary tracer material, and not detecting said first auxiliary tracer material, determining that said first or second packers are proof.

* * * * *